US007675497B2

(12) United States Patent
Park

(10) Patent No.: US 7,675,497 B2
(45) Date of Patent: Mar. 9, 2010

(54) DRIVING UNIT FOR LIQUID CRYSTAL DISPLAY DEVICE

(75) Inventor: Joon-Kyu Park, Gyeonggi (KR)

(73) Assignee: LG Display Co., Ltd., Seoul (KR)

( * ) Notice: Subject to any disclaimer, the term of this patent is extended or adjusted under 35 U.S.C. 154(b) by 991 days.

(21) Appl. No.: 10/982,779

(22) Filed: Nov. 8, 2004

(65) Prior Publication Data

US 2005/0099381 A1 May 12, 2005

(30) Foreign Application Priority Data

Nov. 10, 2003 (KR) ..... 10-2003-0079132

(51) Int. Cl.
*G09G 3/36* (2006.01)

(52) U.S. Cl. ..... 345/89; 345/96

(58) Field of Classification Search ..... 345/87–107, 345/209

See application file for complete search history.

(56) References Cited

U.S. PATENT DOCUMENTS 5,477,234 A * 12/1995 Suzuki et al. ..... 345/98
5,828,357 A * 10/1998 Tamai et al. ..... 345/89
6,049,320 A * 4/2000 Yeo ..... 345/98
6,137,462 A * 10/2000 Kim ..... 345/94
6,384,806 B1 * 5/2002 Matsueda et al. ..... 345/89
6,724,379 B2 * 4/2004 Markis ..... 345/209
6,778,163 B2 * 8/2004 Ozawa ..... 345/96

FOREIGN PATENT DOCUMENTS

EP 1047039 A1 * 10/2000
JP H06-314080 11/1994
JP 2002-533788 10/2002
JP 2005-529369 9/2005

* cited by examiner

*Primary Examiner*—Chanh Nguyen
*Assistant Examiner*—Adam J Snyder
(74) *Attorney, Agent, or Firm*—McKenna Long & Aldridge LLP

(57) ABSTRACT

A driving unit for a LCD device, including: a ramp signal generating unit for dividing a ramp signal into a first ramp signal and a second ramp signal; an input register unit for sequentially storing N-bit image data; a counter unit for outputting control signals by receiving bits of image data except for the most significant bit and counting based upon the received bits; a ramp signal selecting unit for selecting the first ramp signal or the second ramp signal according to the most significant bit and outputting the selected ramp signal upon receiving the most significant bit from the input register unit; and a switching unit for sampling the first ramp signal or the second ramp signal provided from the ramp signal selecting unit by the control signals of the counter unit and outputting the sampled ramp signal to data lines.

5 Claims, 8 Drawing Sheets

DRIVING UNIT FOR LIQUID CRYSTAL DISPLAY DEVICE

This application claims the benefit of Korean Application No. 2003-79132 filed in Korea on Nov. 10, 2003, which is hereby incorporated by reference in its entirety.

BACKGROUND OF THE INVENTION

1. Field of the Invention

The present invention relates to driving a liquid crystal display device, and more particularly, to a driving unit for a LCD device.

2. Description of the Background Art

In general, a liquid crystal display (LCD) device includes a liquid crystal display panel formed by attaching a thin film transistor array substrate to a color filter substrate with a uniform gap therebetween. A liquid crystal material fills the gap between the two attached substrates, which face each other. The LCD panel also includes a data driving unit for providing image data to the LCD panel and a gate driving unit for providing a scan signal to the LCD panel.

The thin film transistor array substrate has a plurality of data lines arranged at regular intervals in a first direction and a plurality of gate lines arranged at regular intervals in a second direction, which is orthogonal to the first direction. Pixels are defined by the gate lines and the data lines. Each pixel is provided with a switching device.

A pixel electrode and a common electrode are provided at the inner surfaces of the thin film transistor array substrate and the color filter substrate that face each others. The liquid crystal material between the thin film transistor array substrate and the color filter substrate is driven by a voltage difference between the pixel electrode and the common electrode. The brightness of an image displayed on the LCD panel changes in accordance to the voltage of an image data applied to the pixel electrode. The pixels are electrically connected to the data lines through the thin film transistors in response to signals on the gate lines. Accordingly, if the scan signal from the gate driving unit are sequentially supplied to the gate lines, the switching device of the pixels connected to the gate lines to which the scan signal are supplied are turned-on, and the data driving unit provides the pixels with image data through the data lines.

To provide viewers with a high quality image, digital image data is used so that the image data can be easily compressed and an image having a high color content and high resolution can be implemented. The digital image data can be applied to the LCD device using a ramp signal sampling method or a digital/analog converting method. A gamma correction can be more easily done on a pixel in the ramp sampling method by controlling the ramp signals as compared to the digital/analog converting method. Further, a gamma correction in the ramp sampling method does not require an analog circuit.

In the ramp signal sampling method, analog ramp signals are sampled based upon digital image data, and the sampled signals are supplied to the pixels of the LCD device. The ramp signal is a normalized waveform corresponding to the brightness change of an image according to a voltage potential of the image data applied to the LCD device. A related art unit for driving a LCD device using the ramp signal sampling method will be described in detail with reference to FIGS. 1 and 2.

FIG. 1 is an exemplary view of a unit for driving a LCD device in which the related art ramp signal sampling method is applied. As shown in FIG. 1, the related art driving unit of the LCD device includes an input register unit 12 for sequentially sampling and storing N-bit digital image data (DATA [R, G and B]) according to control signals (CS1 to CS3) of a shift register unit 10; a counter unit 20 for outputting control signals (C11 to C13) by individually counting the N-bit digital image data (DATA[R, G and B]) input from the input register unit 12 by a load signal (LOAD) and a clock signal (CLK); and switching units (SW1, SW2 and SW3) for sampling ramp signals (R_RAMP, G_RAMP and B-RAMP) respectively and outputting them to data lines (D1, D2 and D3). The operation of the related art unit of driving an LCD device having such construction will be described in detail with reference to a view showing waveforms in FIG. 2.

FIG. 2 shows graphs of ramp signals, control signals of the counter unit (shown in FIG. 1), and voltages applied to the data lines (shown in FIG. 1). First, the input register unit 12 (shown in FIG. 1) sequentially samples and store N-bit digital image data (DATA[R, G and B]) according to the control signals (CS1 to SC3) of the shift register unit 10. Then, the counter unit 20 receives the N-bit digital image data (DAT[R, G and B]) from the input register 10 by the load signal (LOAD), individually counts each bit of the N-bit digital image data (DATA[R, G and B]) by the clock signal CLK and outputs the control signals (C11 to C13). The N-bit digital image data (DATA[R, G and B]) input from the input register 10 by the load signal is stored in a storage latch formed in the counter unit 20.

In the case that the 6-bit digital image data (DATA[R]) is input into the counter unit 20 as '000100', the counter unit 20 is driven by the clock signal (CLK) and counts the digital image data until '000000' becomes '000100', and outputs the control signal (C11), which is at a high potential during the counting of the image data and transitions to a low potential when the counting is completed. In the case the 6-bit digital image data (DATA[R, G and B]) is provided as '100110', the counter unit 20 is driven by the clock signal (CLK) and counts the digital image data until '000000' becomes '100110', and outputs the control signal 12 as a high potential during the counting of the image data and transitions to a low potential when the counting is completed. In addition, when the 6-bit digital image data (DATA[R, G and B]) is provided as '111111', the counter unit 20 is driven by the clock signal (CLK) and counts the digital image data until '000000' becomes '111111', and outputs the control signal 13 as a high potential during the counting of the image data and transitions to a low potential when the counting is completed.

Meanwhile, the switching units (SW1, SW2 and SW3) receive the control signals (C11, C12 and C13) individually from the counter unit 20 and are turned-on by the high potential control signals (C11, C12 and C13) such that sample waveforms of the ramp signal (R_RAMP, G-RAMP and B_RAMP) are supplied to the data lines (D1, D2 and D3). The highest potential of the sampled waveforms (R_RAMP, G-RAMP and B_RAMP) according to digital information of the N-bit digital image data (DATA[R, G and B]) is set as a pixel voltage and then supplied to the data lines (D1, D2 and D3). The sample waveforms are provided to the pixels of the gate lines turned-on by a scan signal as well as the pixel voltage, which is maintained for one frame.

In the LCD device using the ramp signal sampling method, a gamma correction on the pixels can be easily performed in comparison to the LCD device using a digital/analog converting method. That is, in the LCD device using the digital/analog converting method, the value of a resistance in an analog device has to be precisely adjusted. However, in the LCD device using the ramp signal sampling method, waveforms of a ramp signal supplied to a pixel can be changed such that the gamma correction can be easily performed.

In addition, the LCD device employing the ramp signal sampling method is not largely affected by characteristic differences of transistors as compared to the LCD device employing the digital/analog converting method, which samples the digital image data as an analog form and applies it to the pixels. That is, the LCD device using the digital/analog converting method requires an analog circuit such as an operational amplifier (OP-AMP) for converting a digital signal to an analog signal. Since the operational amplifier is very sensitive to characteristic differences of the transistors, it has a high offset voltage and consumes much power. However, since the LCD device using the ramp signal sampling method samples the ramp signal having an analog form according to the digital image data and applies the sampled ramp signal to the pixel, an LCD device using the ramp signal sampling method does not require the analog circuit such as an operational amplifier and is not largely affected by differences in the characteristics of the transistors.

To display a high-definition image using the related art ramp signal sampling method, a large number of image data have to be processed. Therefore, counting using a related art counter unit for counting the digital image data for each pixel becomes complicated. Moreover, image data in one frame is counted such that the ramp signal is sampled to appropriately determine a pixel voltage to display an image. As the number of bits is increased, the correcting section is decreased. Thus, the ramp signal can be sampled before it reaches a desired level for a particular image data. Accordingly, a poor picture quality can be generated by an improper ramp signal for an image data that is processed late.

SUMMARY OF THE INVENTION

Accordingly, the present invention is directed to a driving unit for a LCD device that substantially obviates one or more of the problems due to limitations and disadvantages of the related art.

An object of the present invention is to provide a driving unit for a LCD device which enables to reduce power consumption by simplifying a design of a counter unit Another object is to prevent poor picture quality due to an improper sampling of a ramp signal.

To achieve these and other advantages and in accordance with the purpose of the present invention, as embodied and broadly described herein, there is provided a driving unit for a LCD device includes: a ramp signal generating unit for dividing a ramp signal into a first ramp signal and a second ramp signal and outputting them; an input register unit for sequentially storing N-bit image data; a counter unit for outputting control signals by receiving bits of image data except for the most significant bit and counting based on the received bits; a ramp signal selecting unit for selecting the first ramp signal or the second ramp signal according to the most significant bit and outputting the selected ramp signal upon receiving the most significant bit from the input register unit; and a switching unit for sampling the first ramp signal or the second ramp signal provided from the ramp signal selecting unit by the control signals of the counter unit and outputting the sampled ramp signal to data lines.

In another aspect, a driving unit for a LCD device includes: a ramp signal generating unit for dividing a ramp signal into a first ramp signal and a second ramp signal; a data processing unit for selectively reversing and outputting bits exclusive of the most significant bit according to the most significant bit of the image data; an input register unit for sequentially storing N-bit image data provided from the data converting unit; a counter unit for outputting control signals by receiving the N−1 bit image data exclusive of the most significant bit from the input register unit and counting based upon the N−1 bit image data; a ramp signal selecting unit for selecting the first ramp signal or the second ramp signal according to the most significant bits of the image data from the input register unit and outputting the selected ramp signal; and switching units for sampling the first ramp signal or the second ramp signal provided from the ramp signal selecting unit according to the control signals of the counter unit and outputting the sampled ramp signal to the data lines.

In another aspect, A method for driving a liquid crystal display device includes: dividing a ramp signal into a first ramp signal and a second ramp signal; sequentially storing N-bit image data into an input register unit; outputting control signals by receiving bits of image data except for the most significant bit (MSB) and counting based upon the received bits; selecting the first ramp signal or the second ramp signal according to the most significant bit received from the input register unit and outputting the selected ramp signal; sampling the first ramp signal or the second ramp signal provided from the ramp signal selecting unit by the control signals of the counter unit; and outputting the sampled ramp signal to data lines.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

In the related art driving unit for the LCD device, a design of a counter unit for counting according to number of bits in a digital image data becomes complicated when the amount of image data increases as a resolution is raised to display a high-definition image. Also, as each assigned counting section for which a ramp signal is sampled as many as the number of bits increased in a limited entire counting section is reduced, the sampling is completed before the ramp signal reaches a desired level, and due to the distorted sampling of the ramp signal, poor picture quality is generated.

When the image data of a high picture quality is processed in the driving unit for the LCD device, a method of simplifying the design of the counter unit and preventing poor picture quality by decreasing the number of counted bits is desirable. Thus, the driving unit for the LCD device according to an embodiment of the present invention uses a ramp signal that is different from the related art ramp signal.

Figure 1:
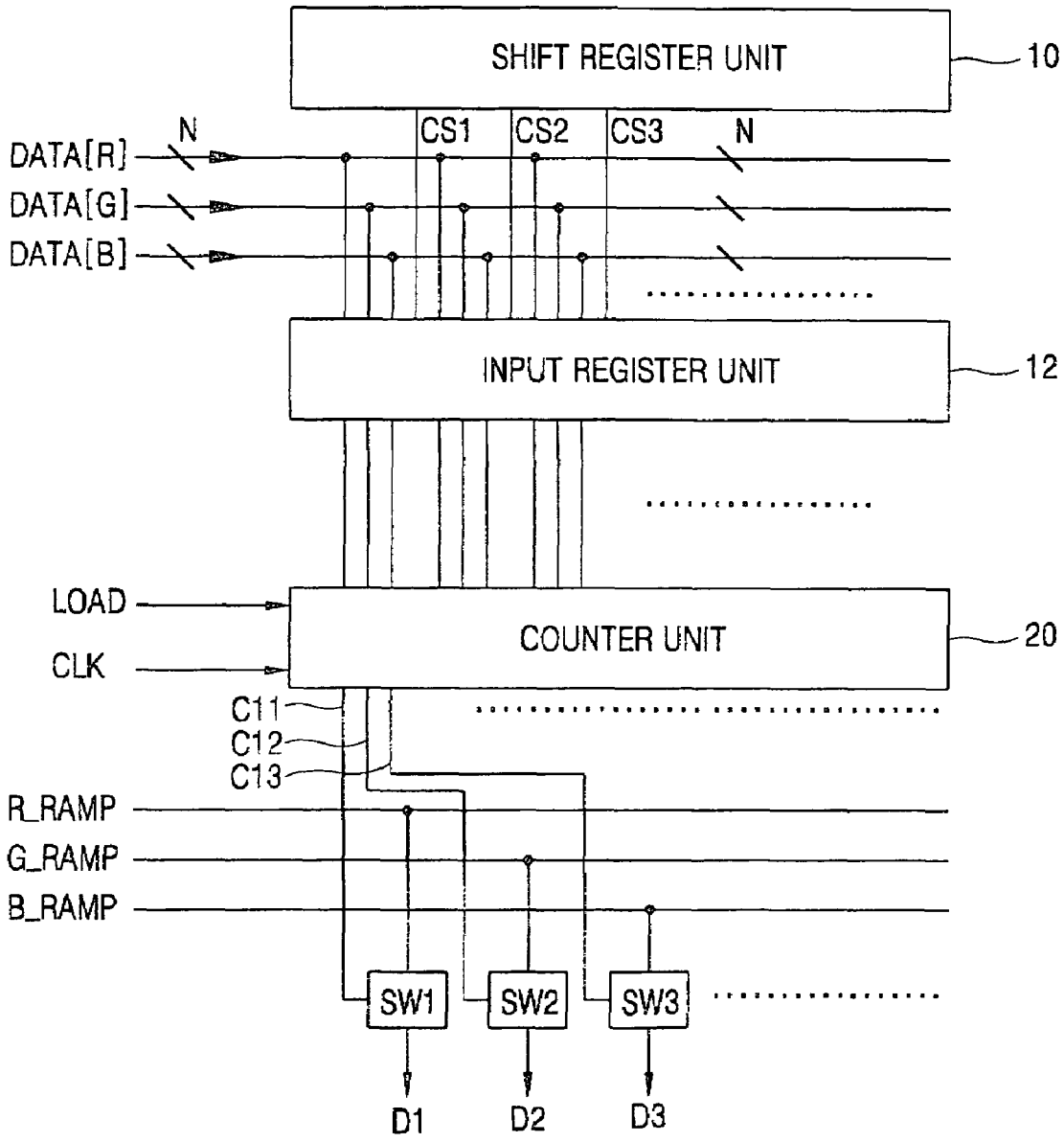
FIG. 1 RELATED ART
FIG. 1 is a schematic view showing the related art driving unit for a LCD device employing the related art ramp signal sampling method.
Figure 2:
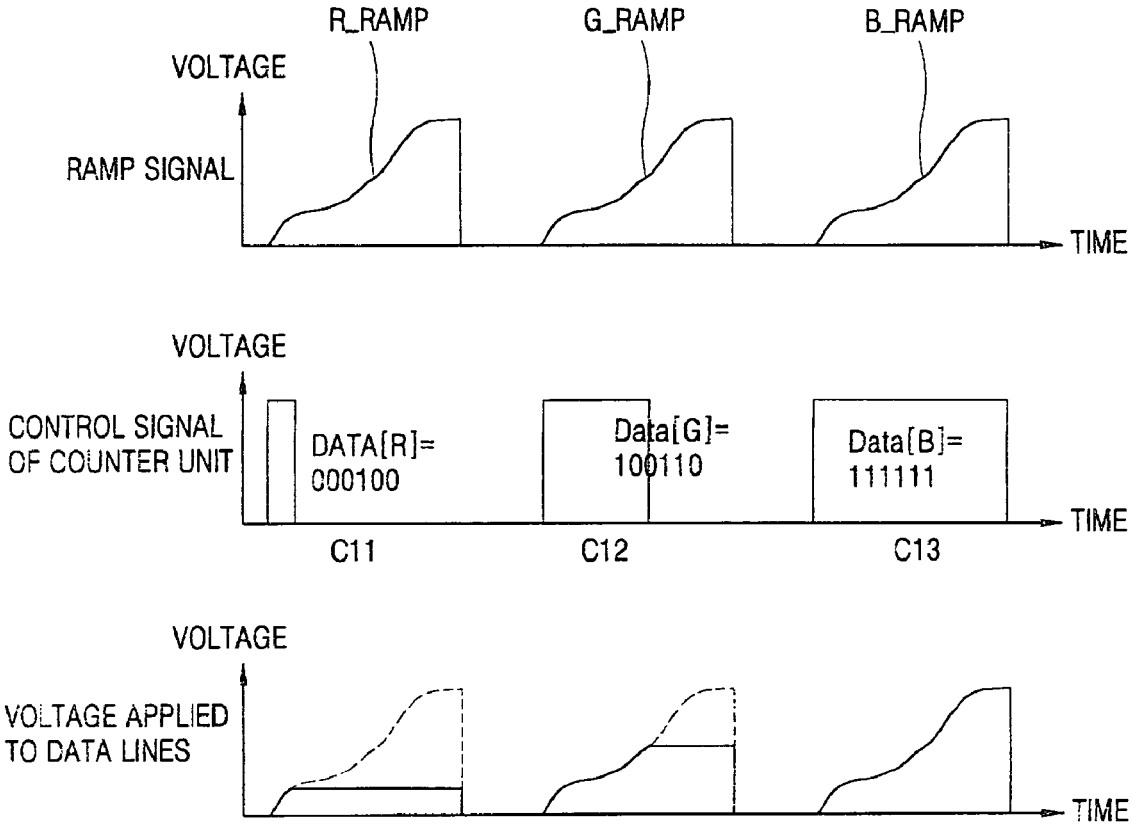
FIG. 2 RELATED ART
FIG. 2 shows waveforms of the related art ramp signals and control signals of the counter unit and voltages of the data lines shown in FIG. 1.
Figure 3:
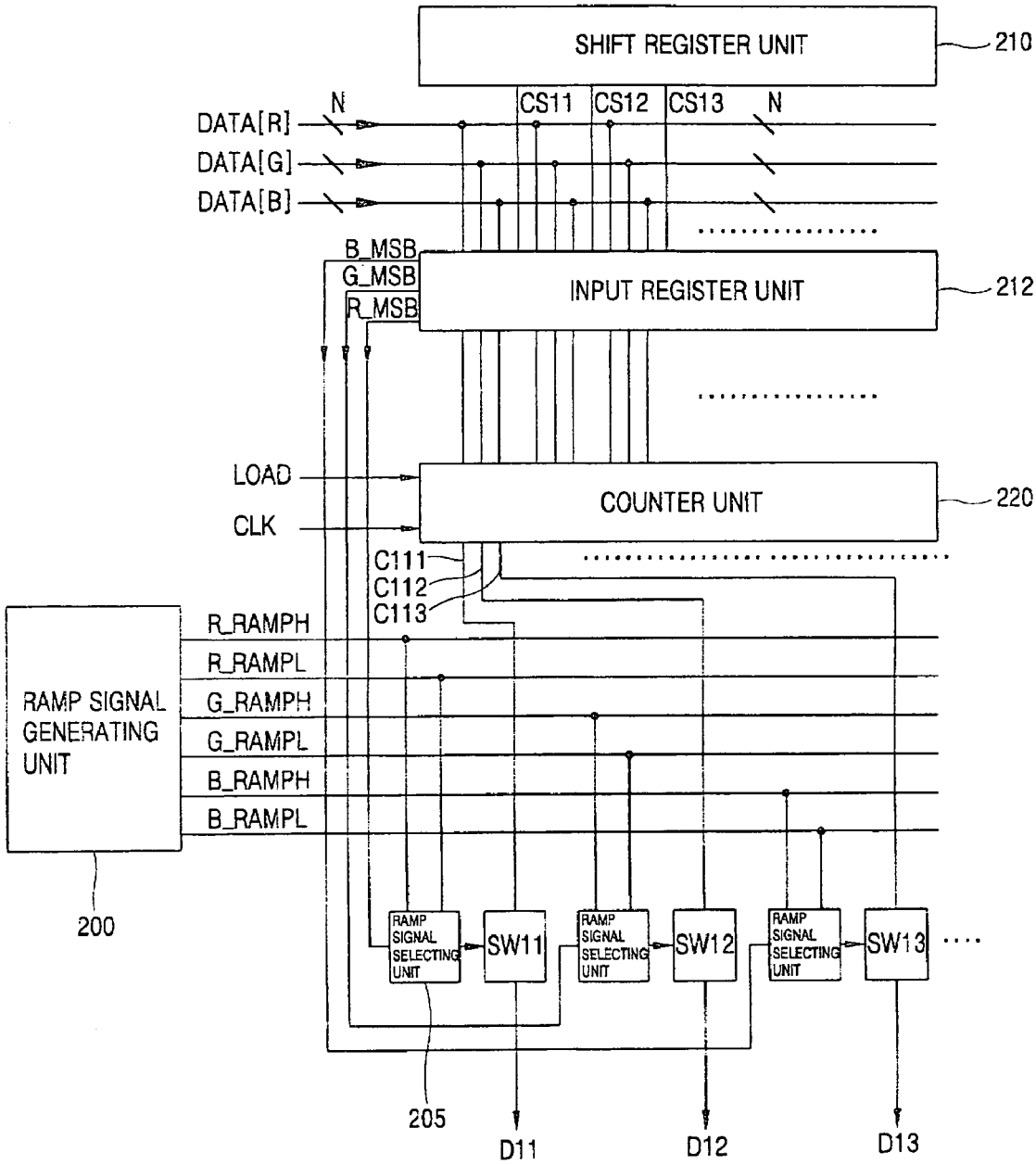
FIG. 3 is an exemplary view showing a driving unit for a LCD device using a ramp signal sampling method in accordance with an embodiment of the present invention.

FIG. 3 is an exemplary view showing a driving unit for a LCD device using a ramp signal sampling method in accordance with an embodiment of the present invention. As shown in FIG. 3, the unit for driving the LCD device includes a ramp signal generating unit 200 for generating a first ramp signal (R-RAMPH, G_RAMPH or B_RAMPH) and a second ramp signal (R-RAMPL, G_RAMPL or B_RAMPL) from a ramp signal and outputting them; an input register unit 212 for sequentially sampling and storing N-bit image data (DATA [R, G and B]) according to control signals (CS11 to CS13) of a shift register unit 210; a counter unit 220 for outputting control signals (C111 to C113) by receiving N−1 bit image data (DATA[R, G and B]) defining the N-bit image data exclusive of the most significant bit (MSB) from the input register unit 212 according to a load signal (LOAD) and a clock signal (CLK) and individually counting the N−1 bit image data; a ramp signal selecting unit 205 for selecting the first ramp signal or the second ramp signal and outputting the selected ramp signal upon receiving the most significant bits (R_MSB, G_MSB AND B_MSB) from the input register unit 212; and a plurality of switching units (SW11, SW12 and SW13) for sampling the first ramp signal or the second ramp signal provided from the ramp signal selecting unit 205 by the control signals (C111 to C113) of the counter unit 220 and outputting the sampled ramp signal to the data lines (D11, D12 and D13).

The driving unit for the LCD device having such a construction in accordance with an embodiment of the present invention will now be described in detail. First, the input register unit 212 sequentially samples and stores the N-bit image data (DATA[R, G and B]) according to the control signals (CS11 to CS13) of the shift register unit 210. Then, the counter unit 220 receives N−1 bit image data defining the N-bit image data (DATA[R, G and B]) except for the most significant of the image data from the input register unit 210 by the load signal (LOAD), individually counts the N−1 bit image data (DATA[R, G and B]) and outputs the control signals (C111 to C113). The control signals are at a high potential during the counting of the N−1 bit image data and transition to a low potential when the counting is completed. At this time, a storage latch provided in the counter unit 220 receives and stores the N−1 bit image data (DATA[R, G and B]) from the input register unit 210 according to the load signal (LOAD).

As described so far, since the N−1 bit image data defining the N-bit image data exclusive of the most significant bit is counted in the counter unit 220, the counting number is reduced by half in comparison to the related art LCD device, thereby simplifying the design of the counter unit.

Meanwhile, the ramp signal selecting unit 205 receives the most significant bits (R_MSB, G_MSB and B_MSB) of image data (DATA[R, G and B]) from the input register unit 212, selects the first ramp signal or the second ramp signal and provides the selected ramp signal to the switching units (SW11, SW12 and SW13).

The switching units (SW11, SW12 and SW13) individually receive the control signals (C111, C112 and C113) from the counter unit 220 and apply waveforms of the ramp signals provided from the ramp signal selecting unit 205 during the high potential section of the control signals (C111, C112 and C113) to the data lines (D11, D12 and D13). The highest voltage level of the first ramp signal (R_RAMPH, G_RAMPH or B_RAMPH) or the second ramp signal (R_RAMPL, G_RAMPL or B_RAMPL) that occurred during the high potential section of the control signals is applied to the data lines (D11, D12 and D13) is maintained for one frame after the control signals (C111, C112 and C113) transition from a high potential to a low potential.

Figure 4:
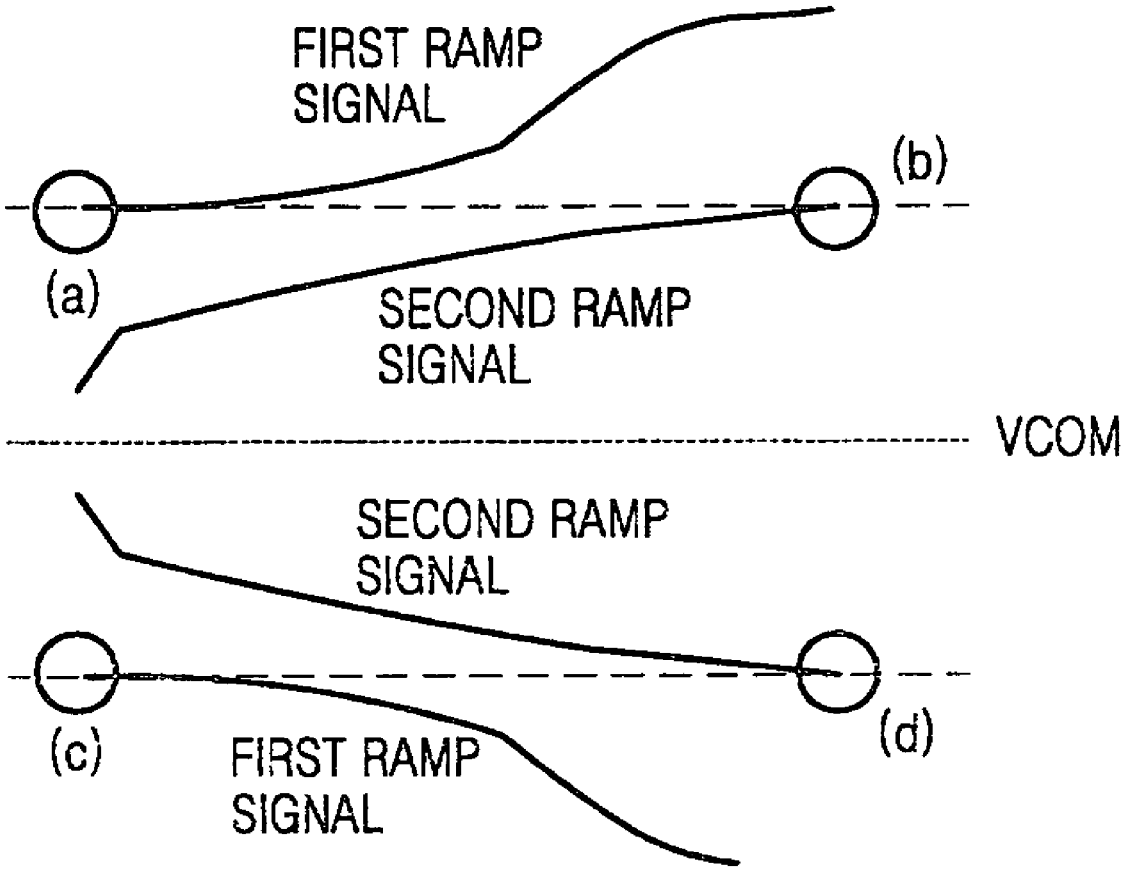
FIG. 4 is a schematic showing waveforms of divided ramp signals generated from the ramp signal generating unit of FIG. 3.

FIG. 4 is a view showing waveforms of divided ramp signals generated from the ramp signal generating unit of FIG. 3. As shown in FIG. 4, a ramp signal is divided into a first ramp signal and a second ramp signal, and the first ramp signal and the second ramp signal have the same start position for the sampling according to the control signals of the counter unit.

The ramp signal is generated for one horizontal period, sampled in accordance with the control signals of the counter unit and applied to the data lines. The divided first and second ramp signals are generated for one horizontal period.

Namely, the first ramp signal or the second ramp signal selected by the ramp signal selecting unit and input to the switching units is generated for each horizontal period and counted according to the control signals of the counter unit. Since the N−1 bit image data alone, the N-bit image data exclusive of the most significant bit, is counted to generate control signals, an allocation for each counting section at which the ramp signal is sampled is increased in an entire counting section. Accordingly, the ramp signal can be sampled after the ramp signal reaches a desired level, improving picture quality.

As shown in FIG. 4, in simply divided ramp signals, such as positions A and B or positions C and D show adjacent gray scales. However, in case there is a difference in sampling time between two points, a difference of leakage current is generated due to the sampling time difference. Thus there is a problem that different gray scales are created. To solve such a problem, a ramp signal according to an embodiment of the present invention is provided. The unit for driving the LCD device using this ramp signal will be described in detail with reference to the accompanying drawings.

Figure 5:
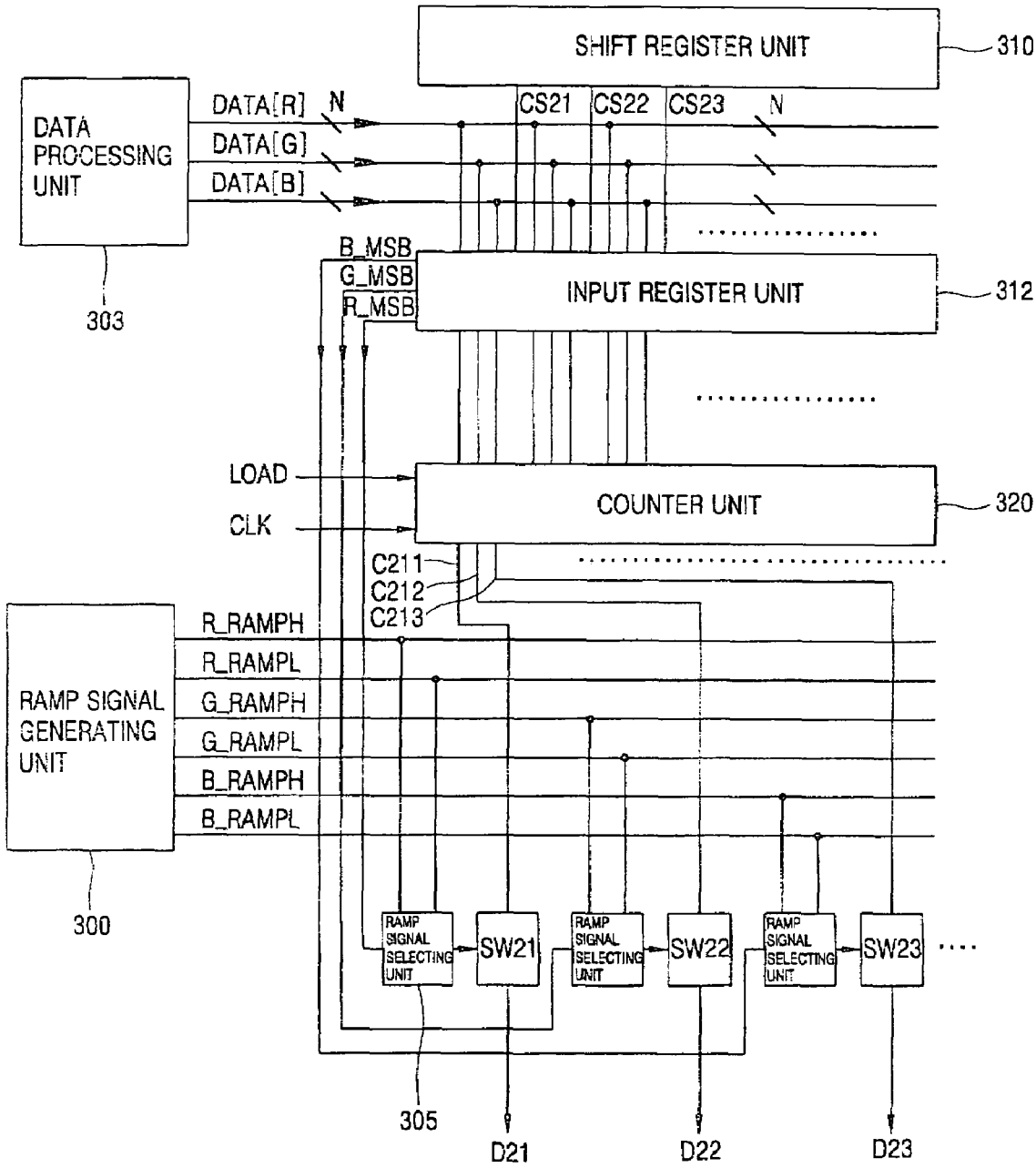
FIG. 5 is an exemplary view for showing a driving unit for a LCD device using a ramp signal sampling method in accordance with an embodiment of the present invention.

FIG. 5 is an exemplary view using a ramp signal sampling method in accordance with an embodiment of the present invention. As shown in FIG. 5, the driving unit for the LCD device includes: a ramp signal generating unit 200 for dividing a ramp signal into a first ramp signal (R_RAMPH, G_RAMPH or B_RAMPH) and a second ramp signal (R_RAMPL, G_RAMPL or B_RAMPL) and outputting them; a data processing unit 303 for selectively reversing and outputting image data (DATA[R, G and B]) of the bits except for the most significant bit according to the most significant bit of the image data (DATA[R, G and B]); an input register unit 312 for receiving and sequentially storing the N-bit image data (DATA[R, G and B]) from the data converting unit 303 according to control signals (CS21 to CS23) of a shift register unit 310; a counter unit 320 for outputting control signals (C211 to C213) by receiving N−1 bit image data (DATA[R, G and B]) from the input register unit 312 through a load signal (LOAD) and a clock signal (CLK) and individually counting the N-1 image data; a ramp signal selecting unit 305 for selecting the first ramp signal or the second ramp signal and outputting the selected ramp signal upon receiving the most significant bits (R_MSB, G_MSB AND B_MSB) of the image data (DATA[R, G and B]) from the input register unit 312; and switching units (SW21, SW22 and SW23) for sampling the first ramp signal or the second ramp signal provided from the ramp signal selecting unit 305 according to the control signals (C211 to C213) of the counter unit 320 and outputting the sampled ramp signal to the data lines (D11, D12 and D13).

In the LCD device in accordance with an embodiment of the present invention, the data converting unit 303 selectively reverses and outputs the image data (DATA[R, G and B]) exclusive of the most significant bit according to the most significant bit of the image data (DATA[R, G and B]) which is provided as '0' or '1'. For example, if image data of 6 bits '100100' and '011000' is provided to the data converting unit 303, the data converting unit 303 reverses bits '00100' except for the most significant bit '1' from '100100' whose most significant bit is '1' and outputs '11011', and it outputs '011000' whose the most significant bit is '0' as it is. Data conversion of the image data exclusive of the most important bits '0' and '1' as described above can be performed by inversely reversing image data according to the most important bits '0' and '1'.

Meanwhile, the input register unit 312 sequentially stores the N-bit image data (DATA[R, G and B]) input from the data converting unit 303 by the control signals (CS21 to CS23) of the shift register unit 310. In addition, the counter unit 320 receives the bits except for the most significant bit, that is, the N−1 bit image data (DATA[R, G and B]) from the input register unit 310 by the load signal (LOAD), individually counts the N−1 bit image data (DATA[R, G and B]) by the clock signal (CLK) and outputs control signals (C211 to C213) which is transited from a high potential during the counting the N−1 bit image data to a low potential when the counting is completed. At this time, the counter unit 320 is provided with a storage latch inside itself, receives the N-bit image data (DATA[R, G and B]) from the input register 310 by the load signal (LOAD) and stores it.

The N−1 bit image data (DATA[R, G and B]) defining the N-bit image data exclusive of the most significant bit is counted in the counter unit 320, so that the counting number is reduced by half in comparison to the related art N-bit image data (DATA[R, G and B]). Meanwhile, the ramp signal selecting unit 305 receives the most significant bits (R_MSB, G_MSB and B_MSB) of the image data (DATA[R, G and B]) from the input register unit 312, selects the first ramp signal (R_RAMPH, G_RAMPH or B_RAMPH) or the second ramp signal (R_RAMPL, G_RAMPL or B_RAMPL) and provides the selected ramp signal with the switching units (SW21, SW22 and SW23). The switching units (SW21, SW22 and SW23) individually receive the control signals (C211, C212 and C213) from the counter unit 320, sample waveforms of the first ramp signal (R_RAMPH, G_RAMPH and B_RAMPH) or the second ramp signal (R_RAMPL, G_RAMPL and B_RAMPL) selectively provided from the ramp signal selecting unit 305 during a high potential section of the control signals (C211, C212 and C213), and applies the sampled waveform to the data lines (D21, D22 and D23). In addition, voltage levels of the first ramp signal (R_RAMPH, G_RAMPH or B_RAMPH) or the second ramp signal (R_RAMPL, G_RAMPL or B_RAMPL) applied to the data lines (D21, D22 and D23) are maintained for one frame when the control signals (C211, C212 and C213) transition from a high potential to a low potential. The data processing unit 303 of the unit for driving the LCD device in which the image data (DATA[R, G and B]) is converted will be described in detail with reference to FIG. 6.

Figure 6:
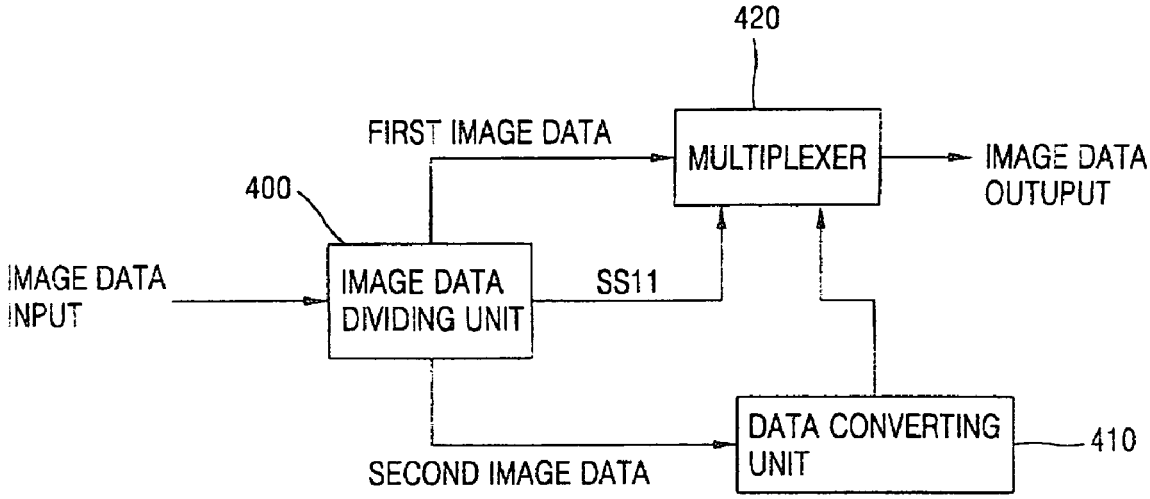
FIG. 6 is a block diagram of the data converting unit in FIG. 5.

FIG. 6 is a block diagram of a data processing unit. As shown in FIG. 6, the data processing unit includes an image data dividing unit 400 for dividing image data into first image data and second image data according to the most significant bit of N-bit image data and outputting it; a data converting unit 410 for reversing bits except for the most significant bit and outputting them upon receiving the second image data input from the image data dividing unit 400; and a multiplexer 420 for selectively outputting the first image data or the second image data out of the first image data directly input from the image data dividing unit 400 and the second image data reversed and then input from the data converting unit 410 according to a selection signal SS11 of the image data dividing unit 400.

The image data dividing unit 400 divides the N-bit image data into the first image data and the second image data according to the most significant bit (MSB) of the N-bit image data, and provides the first image data to the multiplexer 420 and the second image data to the data converting unit 410. The data converting unit 410 receiving the second image data reverses the bits exclusive of the most significant bit of the second image data and applies them to the multiplexer 420.

To explain it easily, image data provided to the image data dividing unit 400 is designated as 6-bit image data. In order to divide a range of the 6-bit image data into two, it can be exactly divided into two on the basis of the most significant bit of the 6-bit image data. That is, if the most significant bit (MSB) of the image data is '1', it indicates the latter half of the image data, from '100000' to '111111', and if the most significant bit of the image data is '0', it indicates the first half of the image data, from '000000' to '011111'. Accordingly, the image data dividing unit 400 divides the image data into the first image data and the second data according to the most significant bit of the image data and outputs the divided the first and second image data.

The data converting unit 410 reverses the second image data and outputs it to the multiplexer 420 as stated above. For instance, when the second image data is designated as '010110', the bits except for the most significant bit is reversed and thus '001001' is output from the data converting unit 410.

The multiplexer 420 receives the first image data from the image data dividing unit 400 and the second image data, in which the bits exclusive of the most significant bit (MSB) are reversed, from the data converting unit 410. The multiplexer 420 selects the first image data or the second image data according to the selection signal SS11 of the image data dividing unit 400 and outputs the selected image data.

The counter unit receives the first image data or the second image selectively output from the data processing unit, counts it and applies the control signals to the switching units. In addition, the switching units sample the first lamp signal or the second ramp signal according to the control signals input from the counter unit. At this time, the ramp signal selecting unit receives the most significant bit (MSB) of the N-bit image data from the input register unit, selects the first ramp signal or the second ramp signal according to the most significant bit (MSB) and applies the selected ramp signal to the switching units. The ramp signal selecting unit will be described in detain with reference to the accompanying drawings.

Figure 7A:
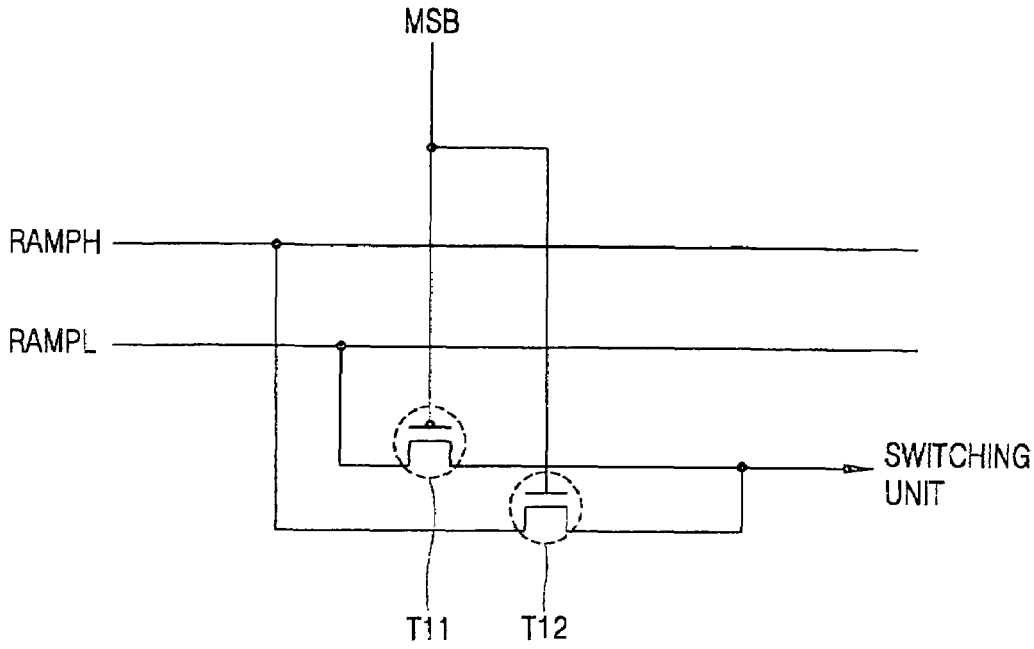
FIG. 7A is an exemplary view showing one example of the ramp signal selecting unit in FIG. 5.
Figure 7B:
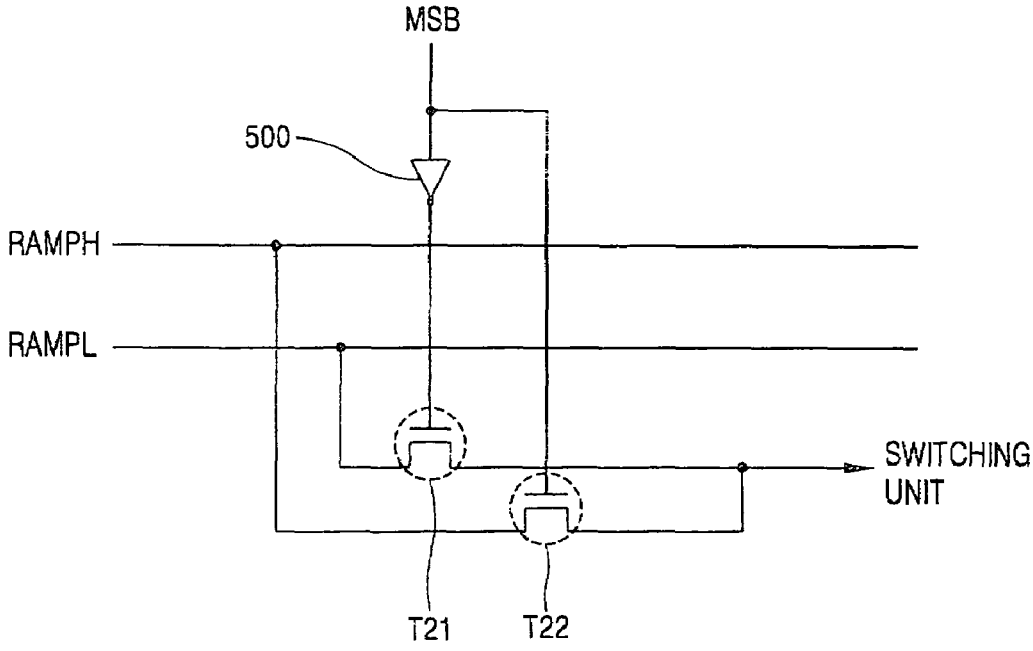
FIG. 7B is an exemplary view showing another example of the ramp signal selecting unit in FIG. 5.

FIG. 7A is an exemplary view showing one example of the ramp signal selecting unit in the FIG. 5. FIG. 7B is an exemplary view showing another example of the ramp signal selecting unit in the FIG. 5.

As shown in FIG. 7A, the first ramp signal (RAMPH) and the second ramp signal (RAMPL) are supplied through supply lines, respectively. The supply lines are electrically connected to the switching devices (T11 and T12) using a transistor, such as a MOSFET (metal oxide semiconductor field effect transistor). At this time, the switching devices (T11 and T12) are turned-on or turned-off according to the most significant bit (MSB) provided from the input register of the unit for driving the LCD device, and the first ramp signal (RAMPH) or the second ramp signal (RAMPL) is provided to the switching unit according to the turned-on switching devices (T11 and T12). Namely, the switching unit samples the first ramp signal (RAMPH) or the second ramp signal (RAMPL) from the ramp signal selecting unit according to the most significant bit (MSB) of the image data.

An operation of the ramp signal selecting unit will be described in more detail as follows. The switching devices (T11 and T12) receives the most significant bit (MSB) of the image data through a gate electrode and the first ramp signal (RAMPH) or the second ramp signal (RAMPL) through a source electrode. The switching devices (T11 and T12) comprise different types of transistors. Accordingly, one of the switching devices is turned-on according to the most significant bit (MSB) of the image data input from the input register unit, receives the first ramp signal (RAMPH) or the second ramp signal (RAMPL) through the source electrode and outputs the supplied ramp signal to the switching units through the drain electrode. For example, if the most significant bit '0' of the image data, that is, a low potential voltage is applied to the gate electrode, a P-type switching device (T11) is turned-on and receives the second ramp signal (RAMPL). If the most significant bit '1' of the image data, that is, a high potential voltage is applied, a N-type switching device (T12) is turned-on and receives the first ramp signal (RAMPH). Namely, The P-type switching device (T11) and the N-type switching device (T12) operate apposite to each other in relation to the low potential voltage or the high potential voltage of the most significant bit (MSB) of the image data, whereby one signal out of the first ramp signal (RAMPH) and the second ramp signal (RAMPL) is passed. The P-type and the N-type switching (T11 and T12) can be in exchanged positions.

FIG. 7B shows another example of a ramp signal selecting unit using N-type switching devices (T21 and T22) having the same polarity. As shown in FIG. 7B, different types of switching devices are used in FIG. 7A, while two identical N-type switching devices are used in FIG. 7B. One of the switching devices is electrically connected to an inverter 500.

As described above, the ramp signal selecting unit comprises the same N-type switching devices (T21 and T22) and has the same operational effect as the ramp signal selecting unit of FIG. 7A. Although both of the ramp signal selecting units have different constructions, provision of the inverter 500 and connection with the different type transistor result in the same operation. For example, if the most significant bit (MSB) '0' of image data is provided from the input register, that is, a low potential is provided, a high potential reversed from the inverter 500 is input to the switching device (T21) connected to the inverter 500 to turn-on the switching device (T21), and a low potential is applied to the other switching device (T22), turning-off the switching device (T22). Namely, the switching device (T21) to which the inverter 500 is connected is turned-on, and thus the second ramp signal (RAMPL) is sampled by the switching unit.

If the most significant bit '1' of the image data is provided, a low potential voltage reversed and then output from the inverter 500 is applied to the switching device (T21) connected to the inverter 500 to turn off the switching device (T21), and a high potential voltage is applied to the other switching device (T22), turning-on the switching device (T22) That is, the second ramp signal (RAMPL) alone passes through the N-type switching device (T21) using the inverter 500 and is sampled by the switching unit. When the same type of switching devices are used, by connecting the inverter to one switching device, different potential voltages are applied to two switching devices according to the most significant bit of the same image data, and thus one signal out of the first ramp signal and the second ramp signal is applied to the switching unit.

Figure 8:
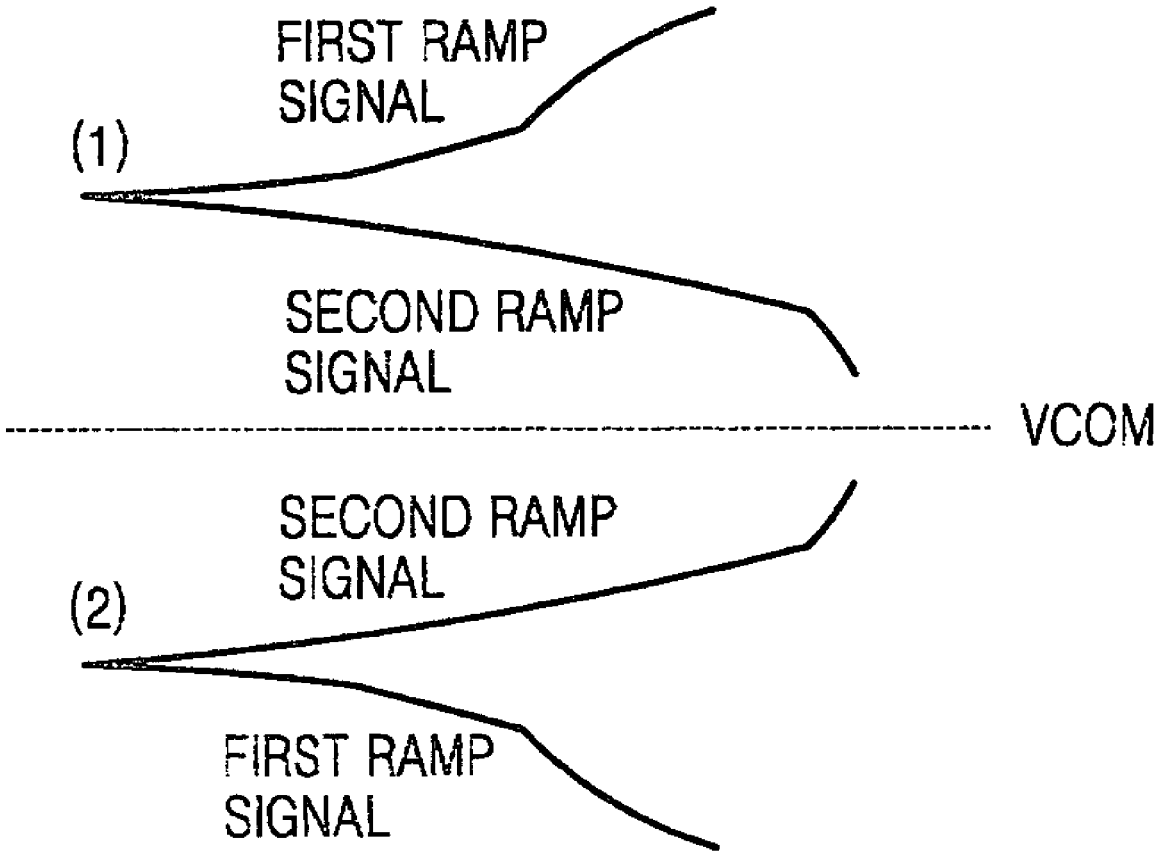
FIG. 8 is a view showing waveforms of the divided ramp signals generated from the ramp signal generating unit of FIG. 5.

FIG. 8 is a view showing waveforms of divided ramp signals generated from the ramp signal generating unit of FIG. 5. As shown in FIG. 4, two adjacent gray scale points in the divided ramp signals, (A) and (B), and (C) and (D) show the same gray scale but have differences in their sampling time. That is, there are certain time differences from when sampling of the divided ramp signals starts at the point (A) or (C) to when the sampling of the same starts at the point (B) or (D). Accordingly, there is difference of gray scale between the two points. The divided ramp signals of FIG. 8 are waveforms that address the problems of simply divided ramp signals, as shown in FIG. 4.

As shown in FIG. 8, a ramp signal is divided into a first ramp signal and a second ramp signal and output from a ramp signal generating unit (not shown). The second ramp signal defines a reversed second ramp signal of simply divided ramp signals and has the same sampling position as the first ramp signal according to the control signal of the counter unit. That is, the second ramp signal is reversed whereby the first ramp signal and the second ramp signal show the identical gray scale at one point ((1) and (2)). Accordingly, the problem of two points showing different gray scales actually is solved.

When the reversed second ramp signal is sampled by the switching unit according to the control signals of the counter unit for counting and outputting image data, the control signal of the counter unit is generated according to waveforms of the original ramp signal before the second ramp signal is reversed. The control signal of the counter unit does not coincide with a start point of sampling the second ramp signal, the second ramp signal is not sampled properly, and accordingly a desired image cannot be displayed properly. Accordingly, the image data should be converted according to the first ramp signal or the second ramp signal as shown in the data converting unit of FIG. 6 and counted in the counter unit. Namely, when the first image data output without processing is counted in the counter unit, the first ramp signal whose sampling start point is not changed is sampled according to the first image data. However, when sampling the reversed second ramp signal, the second ramp signal is sampled according to the second image data. By counting the reversed second image data and corresponding the counted second image data to the start point of sampling the reversed second ramp signal, it is possible to sample the ramp signal having a desired level.

As so far described, in the driving unit for the LCD device in accordance with embodiments of the present invention, the ramp signal is divided and the divided image data corresponding to the divided ramp signal is counted only, and thus the number of the bits of the image data to be counted is reduced less than the half, thereby simplifying a design of the counter unit and reducing power consumption. By sampling the divided ramp signals, it is possible to secure enough time to properly sample the ramp signal in comparison to sampling an entire ramp signal in the conventional art. Accordingly, the ramp signal reaching a desired level can be sampled, thereby preventing deterioration of picture quality.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A driving unit for driving a liquid crystal display device, comprising;

a data processing unit for selectively reversing and outputting bits exclusive of the most significant bit according to the most significant bit of the image data;

an input register unit for sequentially storing N-bit image data provided from the data processing unit;

a counter unit for counting based upon the N−1 bit image data to output control signals by receiving the N−1 bit image data exclusive of the most significant bit from the input register unit;

a ramp signal generation unit for generating ramp signal, the ramp signal including a first ramp signal and a second ramp signal;

a plurality of ramp signal selecting units for selecting the first ramp signal or the second ramp signal according to the most significant bits of the image data from the input register unit and outputting the selected ramp signal; and a plurality of switching units for sampling respectively the first ramp signal or the second ramp signal provided from the ramp signal selecting units according to the control signals of the counter unit and outputting the sampled ramp signal to data lines, wherein the second ramp signal is reversed from the first ramp signal by the control signal from the counting unit so that the voltage level of the first ramp signal at the sampling starting point is same as that of the reversed second ramp signal at the sampling starting point, wherein the data processing unit includes:

an image data dividing unit for converting the second image data by selectively outputting first image data and second image data according to the most significant bit of N-bit image data;

a data converting unit for reversing bits except for the most significant bit of the second image data input from the image data diving unit and outputting the converted second image data; and a multiplexer for selectively outputting one out of the first image data from the image data dividing unit and the converted second image data from the data converting unit according to a selection signal input from the image data diving unit.

2. The driving unit of claim 1, wherein the first ramp signal and the second ramp signal have the same start positions for the sampling according to the control signals of the counter unit.

3. The driving unit of claim 1, wherein the ramp signal selecting unit includes:

a first type transistor for supplying or shielding the first ramp signal supplied to the source electrode to or from the switching according to the most significant bit of the image data supplied through the gate electrode; and a second type transistor for supplying or shielding the second ramp signal supplied to the source electrode to or from the switching unit according to the most significant bit of the image data supplied through the gate electrode.

4. The driving unit of claim 1, wherein the ramp signal selecting unit includes:

a first type transistor for supplying or shielding the first ramp signal supplied to the source electrode to or from the switching unit according to the most significant bit of the image data supplied through the gate electrode; and a first type transistor for supplying and shielding the second ramp signal supplied to the soured electrode to or from the switching device according to the most significant bit of the image data provided to the gate electrode through a inverter.

5. A method for driving a liquid crystal display device, comprising:

generating the ramp signal from a ramp signal generating unit, the ramp signal being divided into a first ramp signal and a second ramp signal;

dividing image data into first image data and second image data according to the most significant bit of N-bit image data;

converting the second image by reversing bits except for the most significant bit of the second image data;

outputting one out of the first image data and the converted second image data according to a selection signal;

sequentially storing N-bit image data into an input register unit;

counting N−1 bit images data to output control signals by receiving N−1 bits of image data except for the most significant bit;

selecting the first ramp signal or the second ramp signal according to the most significant bit received from the input register unit and outputting the selected ramp signal;

sampling the selected ramp signal by the control signals; and outputting the sampled ramp signal to data lines, wherein the second ramp signal is reversed from the first ramp signal by the control signal so that the voltage level of the first ramp signal at the sampling starting point is same as that of the reversed second ramp signal at the sampling starting point.

* * * * *